US005941003A

United States Patent [19]

Thalenfeld

[11] Patent Number: 5,941,003

[45] Date of Patent: Aug. 24, 1999

[54] FLIP-UP LABEL HOLDER WITH IMPROVED MOUNTING FEATURE

[75] Inventor: David R. Thalenfeld, Bear Creek, Pa.

[73] Assignee: Trion Industries, Inc., Wilkes-Barre, Pa.

[21] Appl. No.: 08/902,414

[22] Filed: Jul. 29, 1997

[51] Int. Cl.[6] ..... G09F 3/18

[52] U.S. Cl. ..... 40/642.01; 40/658

[58] Field of Search ..... 248/230.7, 231.81; 211/57.1, 59.1; 40/642.01, 647, 658, 660, 316

[56] References Cited

U.S. PATENT DOCUMENTS

| | | | |
|---|---|---|---|
| 4,593,824 | 6/1986 | Pfeifer | 211/57.1 |
| 4,649,658 | 3/1987 | Sarton et al. | 40/316 |
| 4,850,557 | 7/1989 | Valiulis | 211/57.1 X |
| 4,876,810 | 10/1989 | Piana et al. | 40/316 |
| 4,882,862 | 11/1989 | Slavsky, Sr. | 40/658 X |
| 5,027,538 | 7/1991 | Wilmes et al. | 40/316 |
| 5,348,167 | 9/1994 | Jensen | 211/57.1 |
| 5,441,161 | 8/1995 | Merl | 211/57.1 |
| 5,442,872 | 8/1995 | Moser | 40/642.01 |
| 5,456,034 | 10/1995 | Lewis et al. | 40/666 |
| 5,645,175 | 7/1997 | Wood | 211/57.1 |
| 5,702,008 | 12/1997 | Thalenfeld | 211/57.1 |

*Primary Examiner*—Joanne Silbermann
*Attorney, Agent, or Firm*—Schweitzer Cornman Gross & Bondell LLP

[57] ABSTRACT

A flip-up label holder for pivotal mounting on a cross bar at the outer end of a merchandise display hook device. The label holder, formed by extrusion of relatively thin, somewhat flexible plastic material is arranged to be mounted by store personnel for pivotal movement on a cross bar at the end of a display hook. An improved form of mounting clip is provided on the label holder to simultaneously facilitate the initial mounting of the label holder on the cross bar, and to enhance the security by which the label holder is retained thereon, to minimize accidental dislodgement of the label holder from its mounted position. A mounting clip on the back of the label holder defines a narrow throat through which the cross bar is forced when mounting the label holder. The new label holder includes one or more angularly disposed rib-like projections engageable with the cross bar during a mounting operation to facilitate the action of camming open the mounting clip at the throat. Once the cross bar is passed through the throat, these same rib-like projections act to inhibit return passage of the cross bar through the throat in an opposite direction thus retaining the label holder more securely on the cross bar.

7 Claims, 2 Drawing Sheets

10
11
12
13
14
15
16
17
18
19
20
21
22
23
24
25
28
29
31

FLIP-UP LABEL HOLDER WITH IMPROVED MOUNTING FEATURE

BACKGROUND AND SUMMARY OF THE INVENTION

The present invention is directed to so-called flip-up label holders used in connection with merchandise display hooks and the like. In particular, the invention is directed to an improved design of such flip-up label holder, to both facilitate its mounting on a display hook and to make the label holder more resistant to accidental or unintended dislodgement.

Merchandise display hooks are commonly and widely used in connection with the sales of various kinds of prepackaged merchandise. Such hooks are designed to be mounted on apertured panel board, racks or other mounting means and are provided with a merchandise support arm which extends outwardly and suspends a plurality of merchandise articles. In many cases, merchandise display hooks are designed to provide an information label associated with the merchandise, containing pricing and other information, bar codes for scanning, etc. For this purpose, a label supporting arm, which may be integral with the merchandise support arm or mounted separately therefrom, extends above the merchandise supporting arm, typically to a position at least slightly forward of the outer end of the merchandise support arm.

An increasingly popular form of label display arrangement for merchandising hooks as described above utilizes a label holder which is pivotally mounted on the label holding arm, enabling the label holder to be pivoted upward and out of the way when desired. This facilitates removal of product from the merchandise support arm by customers, and also facilitates product loading by store personnel. To this end, the label supporting arm is provided at or near its outer end with a cross bar element on which the label holder is pivotally mounted.

A popular form of flip-up label holder is formed of thin plastic material, of extruded construction, and comprises front and rear panels flexibly joined along their bottom edges and providing an open top cavity for receiving a product label. A mounting clip is provided along the upper edge of the back panel for mounting of the label holder onto the cross bar of the label support arm. The mounting clip typically extends across the full width of the label holder, and includes a partially cylindrical cavity of an appropriate diameter to receive the cross bar and a downwardly opening entrance or throat. The dimensions of the throat are smaller than the diameter of the cross bar, such that the mounting clip must be cammed open in order to mount the label holder, but it then serves to retain the label holder in its mounted position, allowing it to be pivoted upwardly as desired. A center portion of the mounting clip is notched out in order to accommodate the outwardly extending label support arm, when the label holder is pivoted to an upwardly oriented position for product loading or removal.

The arrangements for installing of the pivoted label holder onto its cross bar mounting are characterized by the somewhat inconsistent and mutually exclusive requirements of easy installation and difficult removal. When initially installing the merchandise display hooks, store personnel must be able to quickly and efficiently mount the label holders with a minimum of time expenditure. At the same time, it is very important that the label holders not come off easily and accidentally, because efficient store operations are impaired if pricing and information labels become disassociated with the product.

In accordance with the present invention, a novel and improved form of flip-up label holder is provided which includes special features to both facilitate mounting of the label holder in the first instance and to inhibit its accidental removal or dislodgement thereafter. To this end, the mounting clip of the label holder is provided in the region of its throat or entrance with one or more rib-like projections which serve during the installation operations to assist in camming open the mounting clip to receive the cross bar and which function thereafter to render it more difficult to remove or dislodge the label holder from the cross bar. To advantage, the rib-like projections are inclined in a direction toward the cavity of the mounting clip to enhance the camming open of the clip as well as to inhibit movement of the cross bar out of the cavity.

For a more complete understanding of the above and other features and advantages of the invention, reference should be made to the following detailed description of preferred embodiments of the invention and to the accompanying drawings.

DESCRIPTION OF PREFERRED EMBODIMENTS OF THE INVENTION

Figures 1, 2, 3:
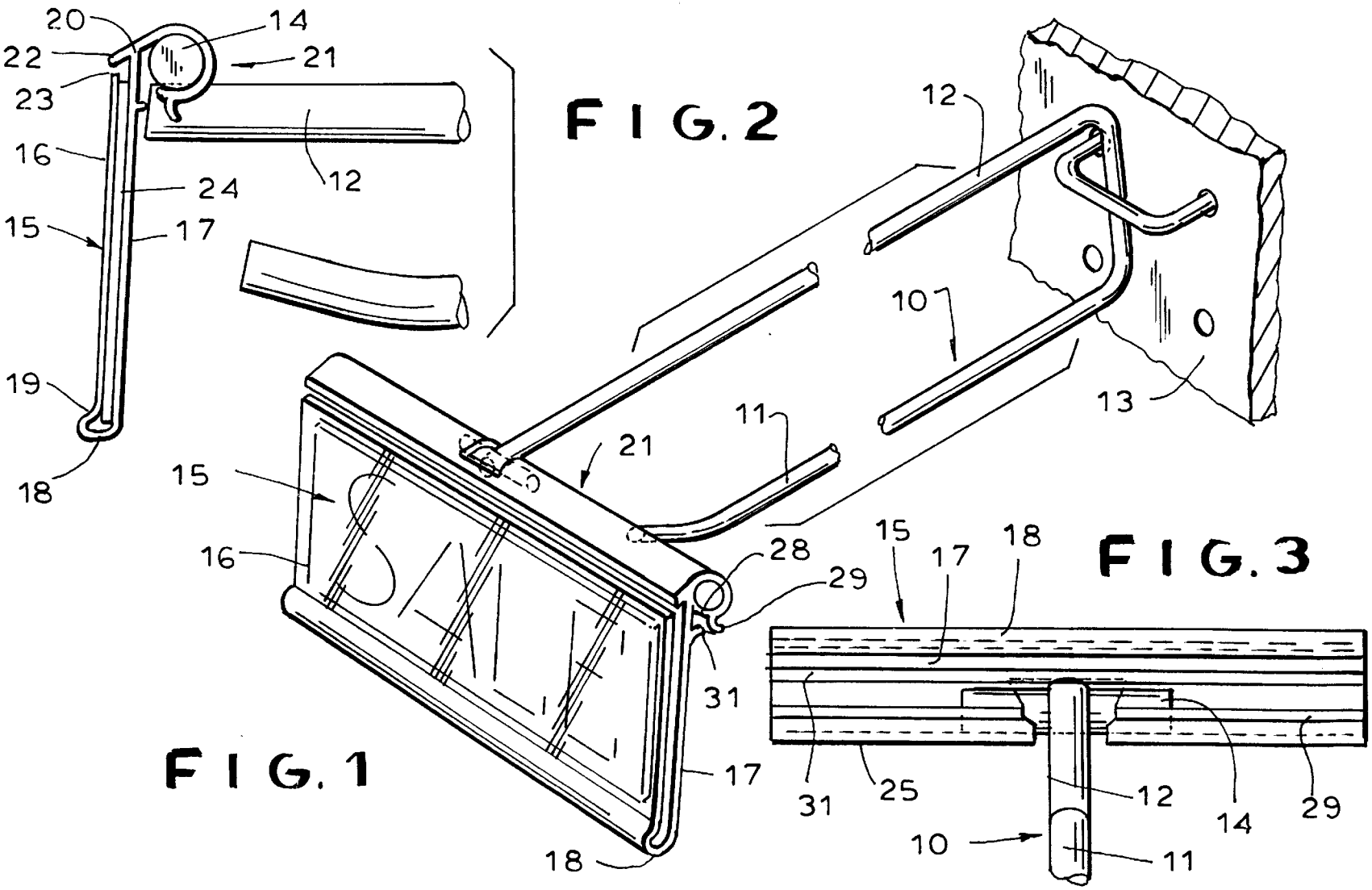
FIG. 1 is a perspective view of a merchandise display hook provided with a flip-up label holder according to the invention.
FIG. 2 is a fragmentary side elevational view of the merchandise display hook of FIG. 1.
FIG. 3 is a bottom plan view of the merchandise hook of FIG. 1.

Referring now to the drawing, and initially to FIGS. 1–4 thereof, the reference numeral 10 designates generally a merchandise display hook of the type having a lower merchandise supporting arm 11 and an upper label supporting arm 12. Commonly, but not necessarily, the display hook 10 is mounted on an apertured panel board 13. It will be understood, however, that the display hook may be mounted by any suitable means, among which are slat walls, wire racks, etc.

In the illustrated form of the invention, the upper or label supporting arm 12 is provided adjacent its outer end with a cross bar element 14. In one advantageous embodiment of the invention, the label supporting arm 12 is formed of steel wire, and the cross bar 14, also formed of steel wire, is welded tangentially to the upper surface of the label supporting arm 12 at or closely adjacent its outer end. The particular form and structure of the cross bar is not material to the present invention, however. It may, for example, be an integral, bent outer end portion of the label supporting arm 12, or it may be a separate attachment, such as a plastic adaptor, for example. For the purposes of the present invention, it is only necessary that the label supporting arm 12 be provided in some manner with a cross bar element.

A label holder 15 is formed of extruded plastic material, typically a rigid polyvinyl chloride, and comprises a front panel 16 of clear plastic, and a back panel 17. The front and back panels 16, 17 are joined integrally at the bottom, by a connecting section 18, which can be provided with a forwardly extending lip 19. The label holder is of uniform cross section throughout and can be of any overall width appropriate to the size of label to be accommodated. The construction of the label holder is such that the clear front panel or cover 16 tends to press resiliently against the front surface of the back panel 17 for gripping a paper label 24 inserted between the panels.

Along its upper edge 20, the back panel joins with a mounting clip, generally designated by the numeral 21, to be described in more detail, which extends rearwardly of the back panel and is arranged to engage the cross bar 14 for mounting of the label holder thereon. A flange 22 extends forward and downward from the upper edge of the back panel 17 and overlies and is spaced from the upper edge 23 of the front cover panel.

By pressing rearwardly on the lower edge portion of the label holder 15, the upper edge 23 of the front cover is displaced forwardly, opening the space between the front and back panels. This permits the label 24 to be inserted in or removed from the cavity between the respective panels. When the rearward pressure is released from the lower edge of the label holder, the front panel returns to the position shown in FIG. 2, pressing the label against the back panel 17 so that it remains in the desired position, visible through the transparent material of the front cover.

In a typical case, a merchandiser utilizing a display hook of the general type shown in FIG. 1, receives from the manufacturer the hook 10 separate from the label holder 15. The mounting of the label holder on the display hook is then carried out by the store personnel. It is important, therefore, that the task of assembling the label holder on the cross bar 14 be able to be carried out quickly and efficiently by relatively unskilled personnel. At the same time, it is also important that the label holder 15, once mounted on the cross bar 14, be securely retained thereon against accidental dislodgement by store customers and/or personnel. To a great extent, these two requirements tend to be mutually exclusive in that the more readily the label can be installed upon the cross bar 14, the more readily it can be removed therefrom. Pursuant to the present invention, however, the mounting clip portion of the label holder is modified in a manner that simultaneously facilitates mounting of the label holder on a display hook and renders its removal, at least accidental or unintended removal, more difficult.

Figures 4, 5, 6:
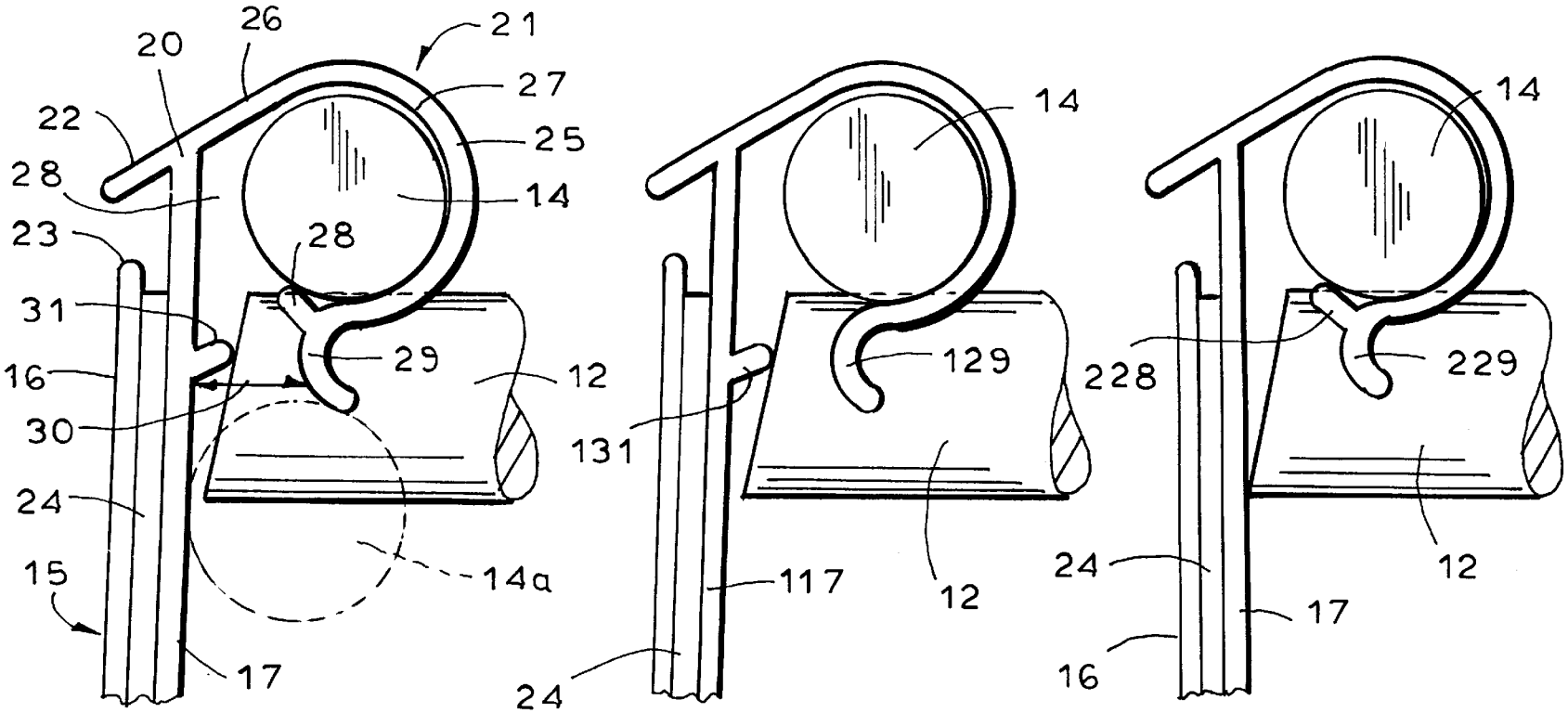
FIGS. 4–6 are enlarged, fragmentary views of three preferred embodiments of the invention, showing details of construction thereof.

Referring particularly to FIG. 4 of the drawings, the mounting clip portion 21 comprises a portion 25 of cylindrical contours which joins with a top flange portion 26 extending upwardly and rearwardly from the upper edge of the back panel 17. The cylindrical portion as shown in FIG. 4 extends through an arc of about 210° degrees (i.e. comfortably greater than 180°) and defines a cavity 27 for receiving and retaining the cross bar 14. Joined with the cylindrically contoured mounting portion 25 is an arcuate guide flange 29 which preferably extends in a smooth arc downward from the end of the cylindrically contoured mounting portion 25 and then rearward with respect to the back panel 17.

Adjacent its end, the cylindrically contoured portion 25 joins with a forwardly extending rib-like projection 28. As will be seen in FIG. 4, the rib-like projection 28 extends forward and upward in relation to the orientation of the back panel 17 which, for purposes of this description, is assumed to be generally vertical. The projection 28 thus functions to some extent as an extension of the cylindrically contoured portion 25.

Although the invention is not limited to specific dimensions, in a typical case the cross bar 14 may have a diameter of, for example, about 3/16 of an inch, and the cylindrically contoured mounting portion 25 is formed with a diameter slightly greater, so as to provide a slight clearance between it and the cross bar, to accommodate free pivoting movement of the label holder. In an advantageous embodiment of the invention, as shown herein, the length of the rearwardly projecting top flange 26 is such as to locate the center of curvature of the cylindrically contoured mounting portion 25 somewhat offset from the back panel 17, providing a clearance space 30 between the back panel and the cross bar 14, when the label holder is installed.

When mounting the label holder of FIG. 4 on a cross bar 14, the label holder is applied over the top of the cross bar as shown for illustrative purposes at 14*a* in FIG. 4. The back surface of the panel 17 engages the front of the cross bar 14, and the arcuate guide flange 29 initially contacts an upper, rearwardly facing surface portion of the cross bar, as reflected in FIG. 4. The forwardmost surfaces of the guide flange 29 define, with the back surface of the back panel 17 a first throat dimension A that is substantially less than the diameter of the cross bar 14. For example, in a typical and advantageous embodiment of the invention, for mounting on a cross bar of approximately 3/16 inch in diameter, the first throat area 30, extending from the forwardmost portion of the arcuate guide flange 29 to the rear surface of the back panel 17 may be approximately 0.120 inch. As the label holder is pressed downwardly on the cross bar 14, the guide flange 29 is forced rearwardly, tending to cam open the cylindrically contoured mounting portion 25. In this respect, the label holder and in particular the mounting portion thereof is formed of a relatively thin rigid polyvinyl chloride material of a representative thickness of, for example, 0.025 inch, which readily flexes sufficiently to admit the cross bar 14 into the restricted throat area 29 forming the opening of the mounting clip.

In the form of the invention shown in FIG. 4, a rib-like projection 31 is formed on the back panel 17 and extends rearwardly therefrom. Preferably, the projection 31 extends upwardly at an angle relative to a perpendicular from the back panel 17, at a location generally opposite the narrow dimension of the throat 30. As the cross bar 14*a* enters the throat during mounting of a label holder, upper front surface portions of the cross bar engage the upwardly inclined projection 31. In a preferred embodiment of the invention, the rib-like projection 31 extends rearwardly a distance of, for example, 0.056 inch, and inclines upwardly at, for example, 30°. Thus, when the cylindrical cross bar engages the projection 31, a combination of the upward incline of the projection and the incline of the upper front surface portions of the cross bar function to easily displace the cross bar rearwardly relative to the back panel 17. This forces the guide flange 29, and therefore the cylindrically contoured portion 25 rearwardly, further opening the entrance gap into the cavity 27, to open further to accommodate passage of the cross bar.

In the embodiment of FIG. 4, the cross bar 14, after engaging and being displaced rearwardly by the rib-like projection 31, engages the oppositely directed rib-like projection 28. Upon continued upward movement of the cross bar, the coaction of the rib-like projection 28 and the upper back surface portions of the cross bar serve to further displace the end of the cylindrically contoured portion 25, allowing the cross bar to pass easily through the narrow entrance opening and to enter the cavity 27. Once the cross bar is within the cavity, the natural resiliency of the plastic material causes the cylindrically contoured portion 25 to close around a cross bar and lock it in position for the desired free pivoting action.

In the illustrated form of the invention, the rib-like projection 28 may advantageously extend forwardly from the guide flange 29 to have a projection toward the back panel 17 of, for example, 0.030 inch, for a label holder designed to be mounted on a cross bar of approximately 3/16 inch diameter. The projection 28 preferably extends forwardly and at an upward angle of 30° or so with respect to a perpendicular to the back panel 17.

As will be apparent in FIG. 4, the two rib-like projections 28, 31 function efficiently to assist in camming open the cylindrically contoured portion 25 of the mounting clip, to allow easy installation the label holder on the cross bar 14. Once installed, however, movement of the cross bar out of the cavity 27 is significantly inhibited. In the first instance, it is resisted by the projection 28, which forms in effect a continuation of the cylindrical contoured portion 25. Should the label holder be accidentally bumped or jarred with sufficient force to dislodge the cross bar from the cavity 27, it will be engaged by the rib-like projection 31 extending rearwardly from the back panel 17 and forming a second blocking means to inhibit separation of the label holder from the cross bar.

FIGS. 5 and 6 show modifications of the label holder of FIG. 4 in which only a single rib-like projection is employed to perform the desired functions of the invention. In the embodiment of FIG. 5, for example, the label holder is provided with a rib-like projection 131, which extends upward and rearward from the back panel 117 of the label holder. The guide flange 129 of the mounting clip in this modification has no projection corresponding to the projection 28 of the FIG. 4 embodiment.

In the embodiment of FIG. 6, the label holder is provided with a single rib-like projection 228 which extends from the guide flange 229 and functions in the manner described with respect to the projection 28 of the FIG. 4 embodiment, except that the cross bar element 14, when engaging the rib-like projection 228 will be in contact with the back surface of the panel 17 instead of in contact with the projection 31, as in the embodiment of FIG. 4.

In any of its various forms, the invention provides a simple, economical and highly effective arrangement for imparting significantly greater security to the mounting of flip-up label holders without, at the same time, impeding the operations necessary to mount the label holder onto the display hook in the first instance. By providing one or more angularly disposed, rib-like projections, positioned in the throat area of a mounting clip for the label holder, the label holder provides significant obstacles to the accidental dislodgement of the label holder. At the same time, the favorably inclined surfaces of the rib-like projections allow easy passage of the display hook cross bar in which the cross bar is retained.

The advantageous features of the invention can be incorporated into the flip-up label holder without additional manufacturing operations and with a minimal utilization of materials.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A label display device with flip-up label holder, which comprises (a) a label support arm provided with a cross bar element adjacent an outer end portion thereof, (b) a flip-up label holder pivotally mounted on said cross bar element, (c) said label holder being of extruded plastic construction and comprising a label supporting panel, (d) said label holder including a downwardly opening integral mounting clip extending along an upper edge of said panel, (e) said mounting clip being of a partially closed cross sectional configuration defining a cavity having a minimum diameter greater than a diameter of said cross bar for loosely pivotally receiving said cross bar element, to accommodate free pivoting action of the label holder on said cross bar, (f) a free end portion of said mounting clip forming, together with a surface of said panel, a restricted entry throat for passage of a cross bar element into said mounting clip upon elastic deflection of end portions of said mounting clip, (g) at least one of said panel or free end portion being formed with an inclined rib-like projection in the region of said throat operative to cause lateral displacement of said mounting clip end portions during the passage of a cross bar element through said throat, (h) said rib-like projection being inclined in a direction toward said mounting clip cavity to facilitate entry of a cross bar element into said clip and restrict removal of said cross bar from said mounting clip (i) said rib-like projection extending toward said cavity a distance not greater than a small fraction of the diameter of said cross bar, (j) a guide flange extends from the free end portion of said mounting clip, extending first in a downward and then rearward direction, (k) said guide flange being positioned to engage a cross bar element being moved toward said throat to deflect said mounting clip end portion and open said throat for the passage of said cross bar element, and (l) said rib-like projection being positioned to engage said cross bar after engagement of said cross bar by said guide flange.

2. A label display device with flip-up label holder, which comprises (a) a label support arm provided with a cross bar element adjacent an outer end portion thereof, (b) a flip-up label holder pivotally mounted on said cross bar element, (c) said label holder being of extruded plastic construction and comprising a label supporting panel, (d) said label holder including a downwardly opening integral mounting clip extending along an upper edge of said panel, (e) said mounting clip being of a partially closed cross sectional configuration defining a cavity having a minimum diameter greater than a diameter of said cross bar for loosely pivotally receiving said cross bar element, to accommodate free pivoting action of the label holder on said cross bar, (f) a free end portion of said mounting clip forming, together with a surface of said panel, a restricted entry throat for passage of a cross bar element into said mounting clip upon elastic deflection of end portions of said mounting clip, (g) at least one of said panel or free end portion being formed with an inclined rib-like projection in the region of said throat operative to cause lateral displacement of said mounting clip end portions during the passage of a cross bar element through said throat, (h) said rib-like projection being inclined in a direction toward said mounting clip cavity to facilitate entry of a cross bar element into said clip and restrict removal of said cross bar from said mounting clip (i) said rib-like projection extending toward said cavity a distance not greater than a small fraction of the diameter of said cross bar, (j) said rib-like projection being integral with and extending rearwardly from said label supporting panel, (k) said projection partially closing said throat, (l) a guide flange extends from the free end portion of said mounting clip, extending first in a downward and then rearward direction, (m) said guide flange being positioned to engage a cross bar element being moved toward said throat to deflect said mounting clip end portion and open said throat for the passage of said cross bar element, and (n) said rib-like projection being positioned to engage said cross bar after engagement of said cross bar by said guide flange.

3. A label display device according to claim 2, wherein (a) a second upwardly inclined rib-like projection extends integrally from said mounting clip end portion in a direction toward said label support panel to partially close said restricted throat.

4. A label display device according to claim 3, wherein (a) said second rib-like projection is positioned above said first rib-like projection for engagement with a cross bar element following engagement by said cross bar element with said first rib-like projection.

5. A label display device according to claim 4, wherein (a) said second rib-like projection being of a configuration to function as an extension of said free end portion and to form a portion of said mounting clip.

6. A label display device with flip-up label holder, which comprises (a) a label support arm provided with a cross bar element adjacent an outer end portion thereof, (b) a flip-up label holder pivotally mounted on said cross bar element, (c) said label holder being of extruded plastic construction and comprising a label supporting panel, (d) said label holder including a downwardly opening integral mounting clip extending along an upper edge of said panel, (e) said mounting clip being of a partially closed cross sectional configuration defining a cavity having a minimum diameter greater than a diameter of said cross bar for loosely pivotally receiving said cross bar element, to accommodate free pivoting action of the label holder on said cross bar, (f) a free end portion of said mounting clip forming, together with a surface of said panel, a restricted entry throat for passage of a cross bar element into said mounting clip upon elastic deflection of end portions of said mounting clip, (g) at least one of said panel or free end portion being formed with an inclined rib-like projection in the region of said throat operative to cause lateral displacement of said mounting clip end portions during the passage of a cross bar element through said throat, (h) said rib-like projection being inclined in a direction toward said mounting clip cavity to facilitate entry of a cross bar element into said clip and restrict removal of said cross bar from said mounting clip (i) said rib-like projection extending toward said cavity a distance not greater than a small fraction of the diameter of said cross bar, (j) said upwardly inclined rib-like projection extends integrally from said mounting clip end portion in a direction toward said label support panel to partially close said restricted throat.

7. A label display device according to claim 6, wherein (a) a guide flange extends from the free end portion of said mounting clip, extending first in a downward and then rearward direction, (b) said guide flange being positioned to engage a cross bar element being moved toward said throat to deflect said mounting clip end portion and open said throat for the passage of said cross bar element, (c) said rib-like projection being positioned to engage said cross bar after engagement of said cross bar by said guide flange.

* * * * *